US006412925B1

(12) United States Patent
Takahashi

(10) Patent No.: US 6,412,925 B1
(45) Date of Patent: Jul. 2, 2002

(54) INK JET APPARATUS WITH EJECTION PARAMETERS BASED ON PRINT CONDITIONS

(75) Inventor: Yoshikazu Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 7 days.

(21) Appl. No.: 09/615,334

(22) Filed: Jul. 12, 2000

(30) Foreign Application Priority Data

Jul. 14, 1999 (JP) ..... 11-199978

(51) Int. Cl.[7] ..... B41J 2/045; B41J 29/38
(52) U.S. Cl. ..... 347/69; 347/11; 347/14
(58) Field of Search ..... 347/43, 69, 10, 347/11, 14, 57

(56) References Cited

U.S. PATENT DOCUMENTS

| | | | | |
|---|---|---|---|---|
| 3,946,398 | A | | 3/1976 | Kyser et al. |
| 4,074,284 | A | | 2/1978 | Dexter et al. |
| 4,183,031 | A | | 1/1980 | Kyser et al. |
| 4,189,734 | A | | 2/1980 | Kyser et al. |
| 4,216,483 | A | | 8/1980 | Kyser et al. |
| 4,330,787 | A | | 5/1982 | Sato et al. |
| 4,339,763 | A | | 7/1982 | Kyser et al. |
| 4,459,600 | A | | 7/1984 | Sato et al. |
| 4,506,276 | A | | 3/1985 | Kyser et al. |
| 4,723,129 | A | | 2/1988 | Endo et al. |
| 4,740,796 | A | | 4/1988 | Endo et al. |
| 4,849,774 | A | | 7/1989 | Endo et al. |
| 4,879,568 | A | | 11/1989 | Bartky et al. |
| 4,887,100 | A | | 12/1989 | Michaelis et al. |
| 5,028,936 | A | | 7/1991 | Bartky et al. |
| 5,122,814 | A | | 6/1992 | Endo et al. |
| 5,159,349 | A | | 10/1992 | Endo et al. |
| 5,521,621 | A | | 5/1996 | Endo et al. |
| 5,754,194 | A | | 5/1998 | Endo et al. |
| 6,116,709 | A | * | 9/2000 | Hirabayashi et al. ..... 347/14 |
| 6,206,506 | B1 | * | 3/2001 | Takemura et al. ..... 347/49 |
| 6,213,584 | B1 | * | 4/2001 | Noyes et al. ..... 347/40 |

* cited by examiner

*Primary Examiner*—Thinh Nguyen

(57) ABSTRACT

High print quality can be obtained without changing the drive voltage even when a nozzle has continuously been exposed to air. When ink is ejected immediately after the nozzle has been exposed to air in a non-ejection state, the pulse width of an ink ejection pulse is widened or the number of ejection pulses is increased. This will cope with an ejection defect caused by an increase in ink viscosity that occurs in the vicinity of the nozzle when kept in a non-ejection state, and allow ink droplets to strike at accurate positions.

33 Claims, 12 Drawing Sheets

Fig. 8A

| | NORMAL EJECTION | | INITIAL EJECTION | |
|---|---|---|---|---|
| SIGNAL | EJECTION VELOCITY | DROPLET VOLUME | EJECTION VELOCITY | DROPLET VOLUME |
| SIGNAL 10 | 8.0 | 38.0 | 7.2 | 23.0 |
| SIGNAL 20 | 8.0 | 20.0 | 5.3 | 11.0 |
| SIGNAL 30 | 6.5 | 10.0 | 3.5 | 5.0 |
| | UNIT: m/s | UNIT: pl | UNIT: m/s | UNIT: pl |

Fig. 8B

PRINTING AT MEDIUM RESOLUTION

| CONDITION | SELECTED SIGNAL | EJECTION VELOCITY | DROPLET VOLUME |
|---|---|---|---|
| INITIAL EJECTION | SIGNAL 10 | 7.2 | 23.0 |
| NORMAL EJECTION | SIGNAL 20 | 8.0 | 20.0 |
| | | UNIT: m/s | UNIT: pl |

Fig. 8C

PRINTING AT HIGH RESOLUTION

| CONDITION | SELECTED SIGNAL | EJECTION VELOCITY | DROPLET VOLUME |
|---|---|---|---|
| INITIAL EJECTION | SIGNAL 20 | 5.3 | 11.0 |
| NORMAL EJECTION | SIGNAL 30 | 6.5 | 10.0 |
| | | UNIT: m/s | UNIT: pl |

Fig. 9

| Dw\Wc | 0.10 | 0.15 | 0.20 | 0.25 | 0.30 | 0.35 | 0.40 | 0.45 | 0.50 | 0.55 | 0.60 | 0.65 | 0.70 | 0.75 |
|---|---|---|---|---|---|---|---|---|---|---|---|---|---|---|
| 1.90T | × | × | × | × | × | × | × | × | × | × | × | × | × | × |
| 1.95T | × | △ | △ | △ | △ | △ | △ | △ | △ | △ | △ | △ | △ | × |
| 2.00T | × | △ | ○ | ○ | ○ | ○ | ○ | ○ | ○ | ○ | ○ | ○ | △ | × |
| 2.05T | × | △ | ○ | ○ | ○ | ○ | ○ | ○ | ○ | ○ | ○ | ○ | △ | × |
| 2.10T | × | △ | ○ | ○ | ◎ | ◎ | ◎ | ◎ | ◎ | ◎ | ○ | ○ | △ | × |
| 2.15T | × | △ | ○ | ○ | ◎ | ◎ | ◎ | ◎ | ◎ | ◎ | ○ | ○ | △ | × |
| 2.20T | × | △ | ○ | ○ | ◎ | ◎ | ◎ | ◎ | ◎ | ◎ | ○ | ○ | △ | × |
| 2.25T | × | △ | ○ | ○ | ○ | ○ | ○ | ○ | ○ | ○ | ○ | ○ | △ | × |
| 2.30T | × | △ | ○ | ○ | ○ | ○ | ○ | ○ | ○ | ○ | ○ | ○ | △ | × |
| 2.35T | × | △ | △ | △ | △ | △ | △ | △ | △ | △ | △ | △ | △ | × |
| 2.40T | × | × | × | × | × | × | × | × | × | × | × | × | × | × |
| 2.45T | × | × | × | × | × | × | × | × | × | × | × | × | × | × |

xT

◎ : STABLE UP TO 50° C

○ : STABLE UP TO 40° C

△ : CURVED TRAJECTORY OBSERVED AT 25° C OR LOWER

× : SPLASHES OR NON-DISCHARGE OBSERVED AT 15-25° C

STABLE AT 15° C OR LOWER WITHOUT PULSE C

INK JET APPARATUS WITH EJECTION PARAMETERS BASED ON PRINT CONDITIONS

BACKGROUND OF THE INVENTION

1. Field of Invention

The invention relates to an ink jet apparatus.

2. Description of Related Art

Among non-impact printers that have expanded their market by supplanting existing impact printers, ink jet printers are simplest in principle and easily realize color printing as well as printing in multiple gradations. Particularly, drop-on-demand type ink jet printers, which eject ink droplets for printing, are rapidly becoming widespread because of their excellent ejection efficiency and low running costs.

Typical drop-on-demand type ink jet printers include a Kyser type disclosed in U.S. Pat. No. 3,946,398 and a thermal jet type disclosed in U.S. Pat. No. 4,330,787. However, the Kyser type is difficult to miniaturize, while the thermal jet type requires heat-resistant ink because intense heat is applied thereto.

To simultaneously overcome the above-mentioned problems, U.S. Pat. No. 4,879,568 proposes, as a new system, a shear mode type printer utilizing piezoelectric ceramics.

FIGS. 12 and 13 show an exemplary sectional view of a shear mode type ink jet head. The printhead 600 includes an actuator substrate 601 and a cover plate 602. Formed in the actuator substrate 601 are a plurality of ink channels 613 shaped like a narrow groove and extending perpendicularly to the sheet as shown in FIG. 12, and a plurality of dummy channels 615 carrying no ink. The ink channels 613 and the dummy channels 615 are isolated by sidewalls 617. A sidewall 617 is interposed between each ink channel 613 and each dummy channel 615. The sidewalls 617 are composed of upper walls 609 and lower walls 611, which are polarized in directions P1 and P2, respectively. The directions P1 and P2 are opposite to each other and parallel to the height direction of the side walls 617.

A nozzle 618 is provided at one lengthwise end of each of the ink channels 613. Provided on the other end is a manifold for supplying ink. The dummy channels 615 are closed at the manifold-side ends to block the entry of ink and do not have a nozzle at the other end. Electrodes 619, 621 are provided, as a metal layer, on opposite side surfaces of each of the sidewalls 617. More specifically, two adjacent sidewalls 617, 617 are separated by an ink channel 613, and electrodes 619, 619, 621, 621 are provided on opposite side surfaces of the two adjacent sidewalls 617, 617 to constitute one set of actuators. Each electrode 619 provided on the internal surface of the sidewalls 617, 617 of each of the ink channels 613 is grounded. Electrodes 621, 621, each provided on the side surface facing an associated dummy channel 615, are connected to an associated output circuit 34 (FIG. 4) that generates drive signals.

Upon application of a voltage to two adjacent electrodes 621, 621 on sidewalls 617 separated by an ink channel 613, the upper and lower walls 609, 611 of the two adjacent sidewalls 617, 617 deform, by a piezoelectric shearing effect, in such directions that the volumetric capacity of each of the ink channels 613 increases. More specifically, as shown in FIG. 13, when an ink channel 613*b* is driven, a voltage of E [V] is applied to two adjacent electrodes 621*c*, 621*d*, which are separated by the ink channel 613*b*, while the electrodes 619 of ink channel 613*b* are grounded. Consequently, electric fields are generated on sidewalls 617*c*, 617*d* in the directions E, and the upper and lower walls of the side walls 617*c*, 671*d* deform, by a piezoelectric shearing effect, in such directions that the volumetric capacity of the ink channel 613*b* increases. At this time, the pressure within the ink channel 613*b*, including in the vicinity of the nozzle 618*b* decreases. By maintaining such a state for a period of time required for a pressure wave to propagate, one way, along the ink channel 613*b*, ink is supplied from the manifold (not shown) for that period of time T.

The one-way propagation time T represents a time required for a pressure wave in the ink channel 613*b* to propagate longitudinally along the ink channel 613*b*, and is given by an expression T=L/c, where L is a length (perpendicular to the sheet of FIG. 13) of the ink channel 613*b*, and *c* is a speed of sound in the ink within the ink channel 613*b*.

Based on the theory of propagation of a pressure wave, upon expiration of the time T after the application of a voltage of E [V], the pressure in the ink channel 613*b* is reversed to a positive pressure. Concurrently with the reversing of the pressure, the voltage applied to the electrodes 621*c*, 621*d* are reset to 0 [V].

Then, the sidewalls 617*c*, 617*d* return to their original states, as shown in FIG. 12, and pressurize the ink. The pressure reversed to a positive pressure in addition to the pressure generated upon returning of the sidewalls 617*c*, 617*d* generates a high pressure in the vicinity of the nozzle 618*b* of the ink channel 613*b*. As a result, an ink droplet is ejected from the nozzle 618*b*.

If a time period between application and resetting of the voltage of E[V] does not agree with the one-way propagation time T, energy efficiency for ink ejection decreases. Particularly, when the time period between application and resetting of the voltage is even multiplies of the one-way propagation time, no ink is ejected. Normally, when the time period between application and resetting of the voltage agrees with the one-way propagation time, energy efficiency reaches its peak, and so does the ink droplet ejection velocity. Thus, the time period between application and resetting of the voltage is preferably odd multiplies of the one-way propagation time.

Recently, demands for higher printing resolutions have increased in order to improve print quality. To respond to such demands, it is preferable to reduce the ink droplet volume. The ink droplet volume is usually reduced by reducing the nozzle diameter or by reducing the drive voltage, that is, the ink droplet ejection velocity.

In the printhead 600, when a nozzle 618 is exposed to air in a non-ejection state for a while, the ink solvent in the vicinity of the nozzle 618 evaporates, and the viscosity of ink around the nozzles 618 increases. Consequently, the ink droplet ejection velocity and the ink droplet volume decrease, and the ink trajectory is curved by a sidewind generated when the printhead 600 travels. As a result, ink droplet striking positions are displaced. Ink droplets as tiny as 20 pl (picoliters) or less in volume, are especially susceptible to such a problem. As one of the conventional methods to solve the above-described problem, when the nozzles have been exposed to air in a non-ejection state for a predetermined time, a higher drive voltage than usual is applied to increase the ink droplet ejection velocity. However, changing the drive voltage for each print command increases the cost of a power source. Further, changing the drive voltage requires extra time and disables high-speed printing.

SUMMARY OF THE INVENTION

In view of the foregoing problems, an object of the invention is to provide an ink jet apparatus capable of obtaining excellent print quality, at low cost, without changing the drive voltage.

To achieve the above object, an application time of an ejection pulse is elongated in response to a print command, for at least an initial dot, issued after a nozzle has been kept in a non-ejection state. More specifically, a period of time during which an ejection pulse is applied to an actuator is elongated by widening the pulse width of an ejection pulse or by increasing the number of ejection pulses. By doing so, the volume of an ejected ink droplet is increased, and thus, the ink droplet trajectory becomes unlikely to curve under the influence of the sidewind. Consequently, even when the nozzle has been exposed to air in a non-ejection state for a while, excellent print quality can be obtained without displacement of the ink droplet striking positions.

Although an actuator of the above-described Kyser type, the thermal jet type, or other known types can be used for ejecting ink, it is more preferable to use an actuator of the type in which the volumetric capacity of an ink channel is increased/decreased to generate a pressure wave.

When the time required for a pressure wave to propagate along an ink channel is set as T, the pulse width of an initial ink ejection pulse to be applied to an actuator after the nozzle has been kept in a non-ejection state should be odd multiplies of T. Thereby, energy efficiency is increased more than usual, and the ink droplet ejection velocity is also increased. As a result, the ink droplet trajectory is unlikely to be curved by a sidewind and excellent print quality can be obtained.

Increasing the number of ejection pulses or widening the pulse width can be selectively accomplished by a control device. In the case where printing is performed at various resolutions by changing the ink droplet volume, ink droplets having a volume suitable for a desired resolution can be ejected by increasing the number of ejection pulses or by widening the pulse width, even when the nozzle has been exposed to air in a non-ejection state.

Time elapsed since the nozzle entered a non-ejection state is easily determined by counting, with the use of a timer, the duration of the non-ejection state, or by counting the number of periodically outputted clock signals accompanied by no ejection data.

Further, in a printer that performs printing line by line by shuttling a printhead along the paper, an initial ejection pulse to be applied after a new line has been started can be controlled, in the same manner as described above, by widening the pulse width or by increasing the number of pulses. Thus, even when the nozzle has been exposed to air in a non-ejection state during a line feed operation, or has moved along the paper while being exposed to air, without any ejection data, after a line feed operation, adverse effects on the nozzle can be eliminated.

Further, it is preferable to apply a non-ejection pulse following an ejection pulse in order to cancel the pressure wave vibrations generated by the ejection pulse. This is because, when the ink viscosity is low, ink droplets might be undesirably ejected, or the pressure wave generated by application of the next ejection pulse might be affected by the residual pressure wave vibrations. Thus, the application of a non-ejection pulse enables stable ejection. It also allows the next ejection pulse to be outputted after a very close interval, which enables high-speed printing.

In this case, the crest value of the non-ejection pulse is equal to that of the ejection pulse. The non-ejection pulse should be applied upon expiration of a time period between 2.0T and 2.3T, or more preferably, between 2.1T and 2.2T after the ejection pulse falls. At this time, the pulse width of the non-ejection pulse should be between 0.2 T and 0.65T, or more preferably, between 0.3T and 0.55T.

BRIEF DESCRIPTION OF THE DRAWINGS

A preferred embodiment of the invention will be described with reference to the following figures wherein:

FIGS. 8A, 8B, and 8C are tables showing the results of measurement of the ink droplet ejection velocity and the ink droplet volume obtained by each of the drive signals of FIGS. 7A through 7C;

FIG. 9 shows the results of an experiment conducted to obtain an appropriate time at which a non-ejection pulse is applied and an appropriate pulse width for each of the drive signals of FIGS. 7A though 7C;

DETAILED DESCRIPTION OF PREFERRED EMBODIMENTS

Figure 1:
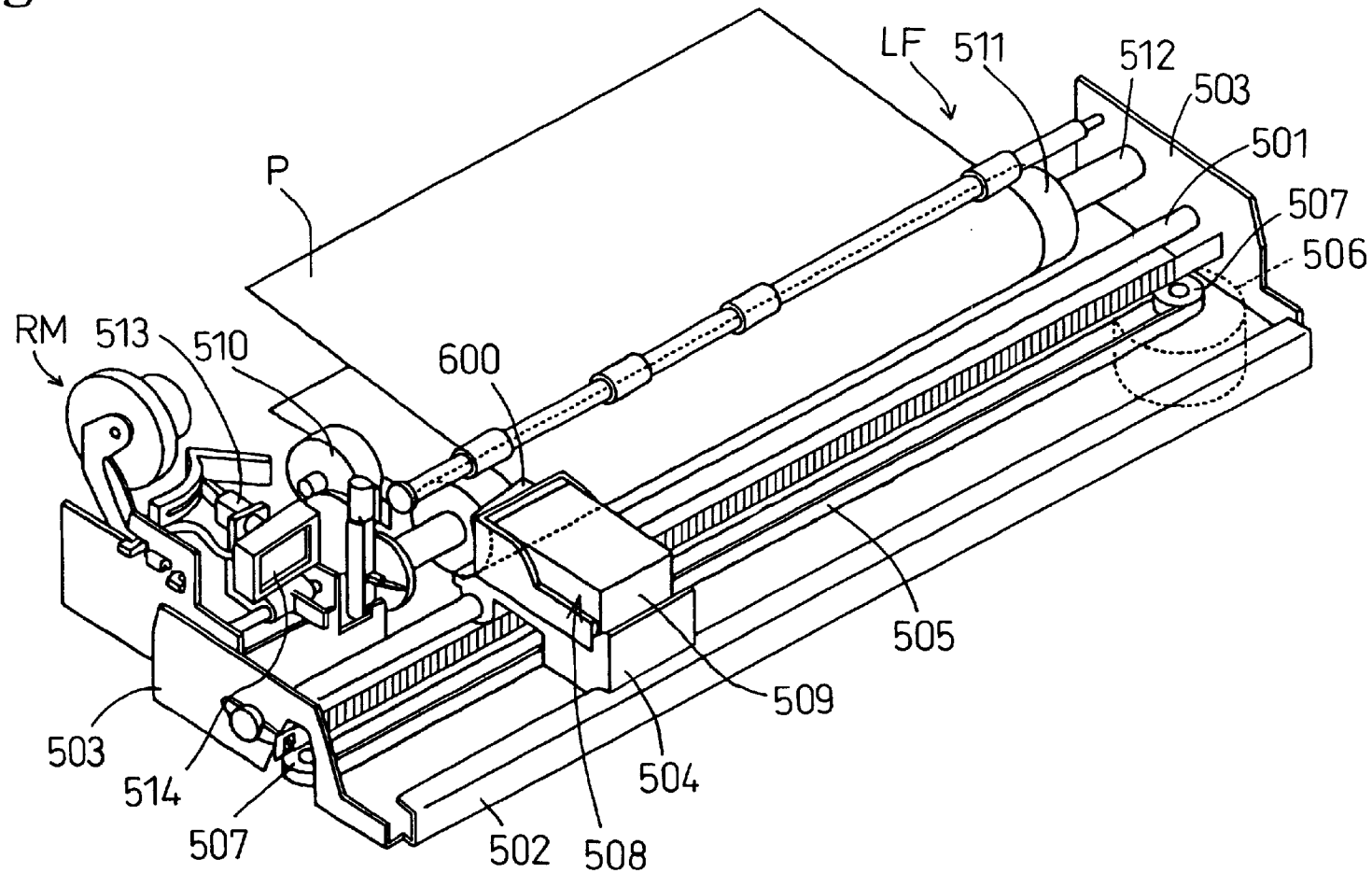
FIG. 1 is a perspective view showing the general configuration of a printer provided with an ink jet apparatus.

FIG. 1 is a perspective view showing the general configuration of a printer including an ink jet apparatus of the invention. A guide rod 501 and a guide member 502 extend between two side plates 503, 503, which partially form a printer frame. A carriage 504 is slidably supported by the guide rod 501 and the guide member 502, and is coupled to a belt 505 so as to be movable together with the belt 505. The belt 505 is wound around two pulleys 507, 507 disposed in the vicinity of opposed ends of the guide rod 501 and the guide member 502. One of the pulleys 507 is connected to a drive shaft of a carriage motor 506. When the carriage motor 506 is driven to rotate the pulley 507, the belt 505 moves, and the carriage 504 reciprocates, together with the belt 505, on the guide rod 501 and the guide member 502.

Mounted on the carriage 504 is a printhead unit 508 provided with a printhead 600 and a drive circuit 21 (FIG. 2) formed by an integrated circuit on a single chip, which will be described later.

Figure 12:
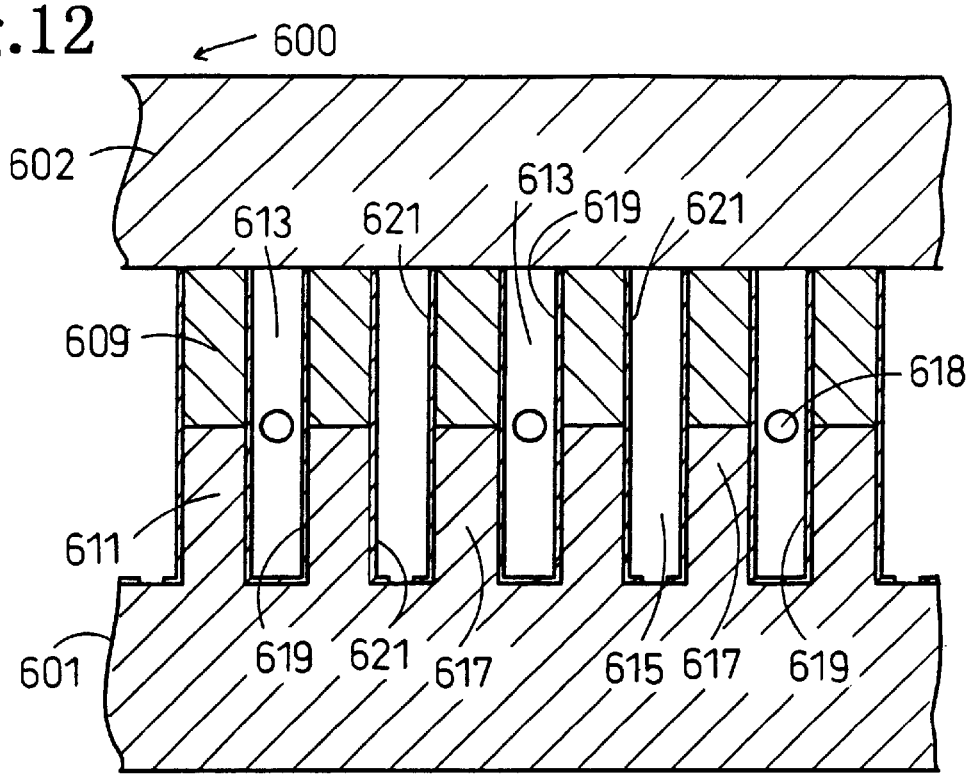
FIG. 12 is a sectional view of a conventional printhead related to the invention.

A known printhead, as shown in FIG. 12, is used as the printhead 600. Because the configuration of the printhead 600 has been described earlier, a further description is omitted here.

The drive circuit 21 is connected to a control circuit 22 (FIG. 2) of the printer via a flexible cable. An ink cartridge 509 contains ink, which is supplied to each of nozzles 618 of the printhead 600, and is detachably mounted to the printhead unit 508. A linefeed mechanism LF for transporting paper P is disposed facing the printhead 600. The linefeed mechanism LF includes a linefeed motor 50 that rotates a platen roller 511. When the platen roller 511 is rotated, paper P is transported perpendicularly to a moving direction of the carriage 504. A roller shaft 512 of the platen roller 511 is rotatably supported by the opposed side plates 503, 503.

A recovery mechanism RM is provided to the side of the linefeed mechanism LF. The recovery mechanism RM includes a pump 513 and a cap 514. The pump 513 communicates with the cap 514 and sucks ink through a nozzle covered by the cap 514. The recovery mechanism RM is driven to correct ink ejecting defects developed when ink is dried within a nozzle 618, when bubbles are generated inside the printhead 600, or when ink droplets are disposed on the outer surface of a nozzle plate (not shown) formed with nozzles 618. When the recovery mechanism RM is driven, the cap 514 is brought into intimate contact with the nozzle plate, and the pump 513 is driven. Then, dried ink or bubbles within and around the nozzle 618 are removed by suction, and the printhead 600 is recovered to a usable state. When the printer is not used, the cap 514 prevents drying of ink by covering the outer surface of the nozzle plate.

Figure 2:
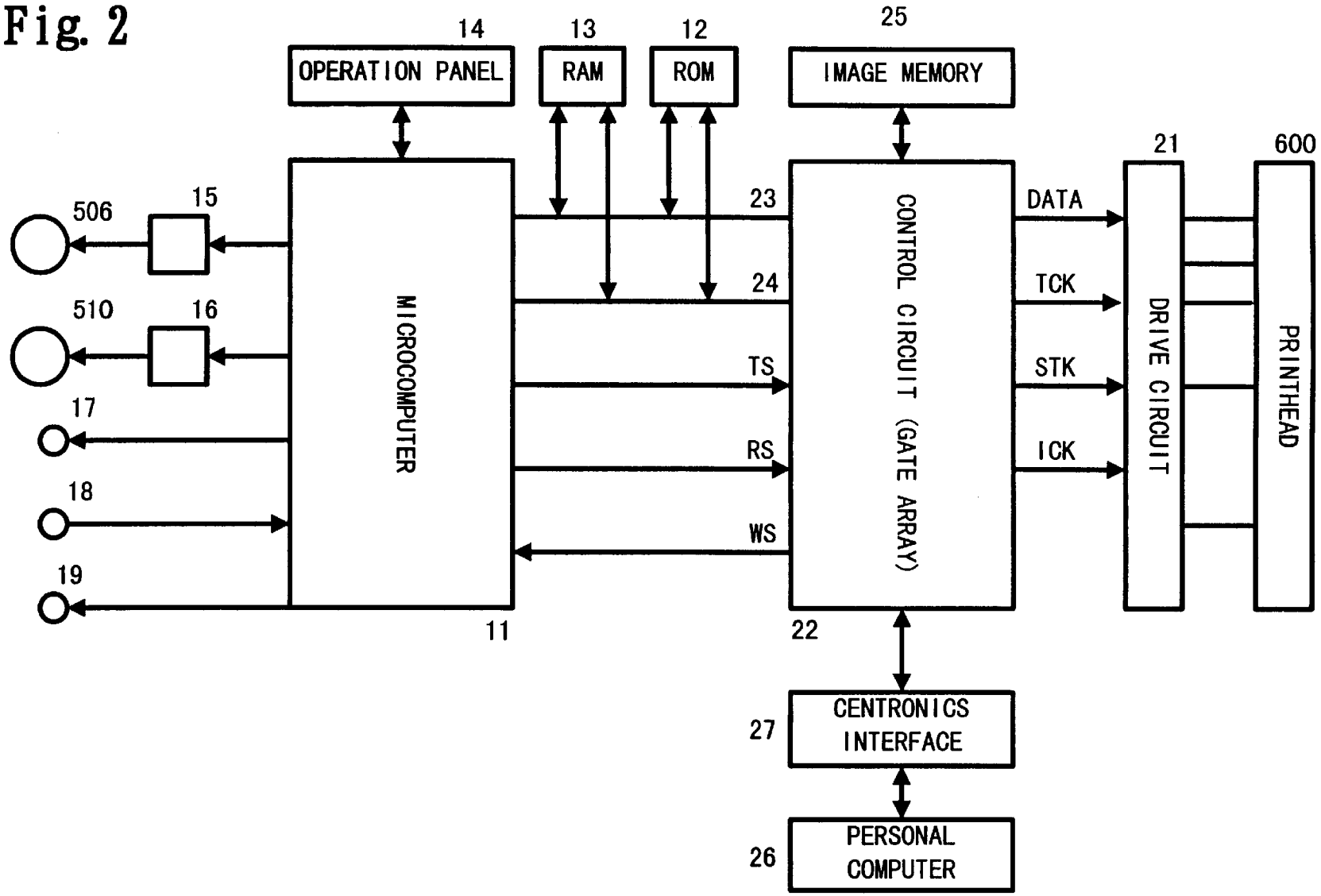
FIG. 2 is a block diagram showing the electrical configuration of the printer.

FIG. 2 is a block diagram showing a control system of the printer. The control system of the printer includes a microcomputer 11 formed by a single chip, a ROM 12, and a RAM 13. Connected to the microcomputer 11 are an operation panel 14 though which a user enters print commands or forcible recovery mechanism operation commands, a carriage motor drive circuit 15 for driving the carriage motor 506, a linefeed motor drive circuit 16 for driving the linefeed motor 510, a paper sensor 17 for detecting a leading edge of paper P, a temperature sensor 18 for detecting the temperature in the vicinity of the printhead 600, a position sensor 19 for detecting the traveling position of the carriage 504.

The printhead 600 is driven by the drive circuit 21, while the drive circuit 21 is controlled by the control circuit 22. As shown in FIG. 12, an electrode 619 is provided in each of the ink channels 613 of the printhead 600, while an electrode 621 is provided in each of the adjacent dummy channels 615. Each of the electrodes 619 is grounded, and each of the electrodes 621 is connected to a drive circuit 21. The drive circuit 21 generates, under the control of the control circuit 22, drive signals suitable for the printhead 600 and applies them to the electrodes 621.

The microcomputer 11, the ROM 12, the RAM 13, and the control circuit 22 are connected to each other via address bus 23 and a data bus 24. The microcomputer 11 generates print timing signals TS and control signals RS according to a program previously stored in the ROM 12, and transmits the signals TS, RS to the control circuit 22.

The control circuit 22 includes a gate array, a transmission clock TCK that synchronizes the transmission data DATA, a strobe signal STB, and a print clock ICK, and generates transmission data DATA on the basis of the print timing signals TS and the control signals RS and based on print data stored in an image memory 25. Then, the control circuit 22 transmits each of the signals DATA, TCK, STB, and ICK to the drive circuit 21. In addition, the control circuit 22 stores print data, transmitted from a personal computer 26 via a Centronics interface 27, in an image memory 25.

Then, the control circuit 22 generates a data reception interrupt signal WS based on the print data transmitted from the personal computer 26, and transmits the signal WS to the microcomputer 11. Each of the signals DATA, TCK, STB, and ICK is transmitted from the control circuit 22 to the drive circuit 21 via the flexible cable.

Figure 3:
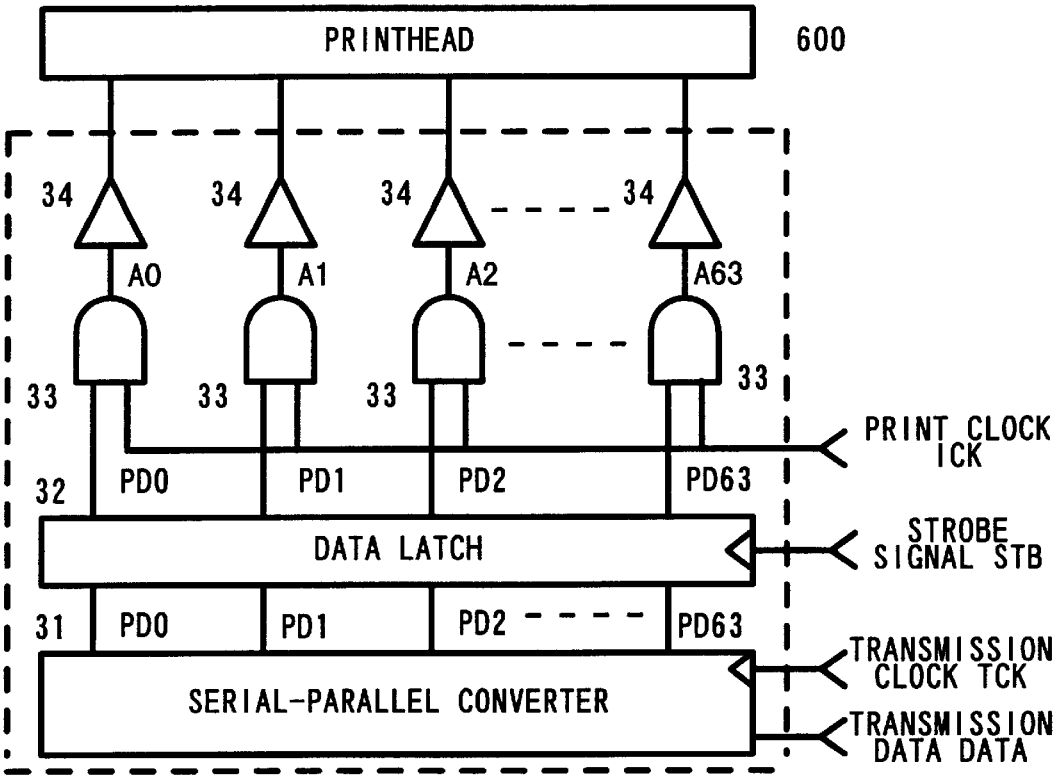
FIG. 3 is a block diagram showing the detailed configuration of a drive circuit of FIG. 2.

FIG. 3 is a block diagram showing the internal configuration of the drive circuit 21. The drive circuit 21 is formed by an integrated circuit on a single chip and includes a serial-parallel converter 31, a data latch 32, AND gates 33, and output circuits 34. The serial-parallel converter 31 is formed by a shift resister having a bit length corresponding to the number of ink channels 613 of the printhead 600 (that is, the number of nozzles 618). In this embodiment, the printhead 600 is provided with 64 nozzles. The serial-parallel converter 31 receives serial transmission data DATA transmitted from the control circuit 22 in synchronism with the transmission clock TCK, and converts the transmission data DATA into pieces of parallel data PD0–PD63 in response to the rise of the transmission clock TCK.

The data latch 32 latches the pieces of parallel data PD0–PD63 separately, in response to the rise of the strobe signal STB transmitted from the control circuit 22. The AND gates 33 are provided in a one-to-one correspondence with the ink channels 613 of the printhead 600. The AND gates 33 perform a logical multiplication of each piece of parallel data PD0–PD63 outputted from the data latch 32 and the print clock ICK transmitted from the control circuit 22, and generate drive data A0–A63 obtained as a result of logical multiplications of the parallel data PD0–PD63. Each of the output circuits 34 generates drive signals based on the drive data A0–A63 and outputs the drive signals to associated electrodes 621 provided in each of the dummy channels 615 of the printhead 600.

Specific dimensions of the printhead 600 will be described as an example. Each of the ink channels 613 is 6.0 mm in length (L). Each of the nozzles 618 is tapered and 25 $\mu$m in diameter on the ink ejecting side, 50 $\mu$m in diameter on the ink channel side, and 75 $\mu$m in length. When the temperature is 25° C., the viscosity of the ink used for an experiment is approximately 2 mPa-sec and its surface tension is 30 mN/m. The ink viscosity increases as the temperature decreases, and decreases as the temperature increases. The ratio L/c of the sound speed c in the ink within the ink channel 613 to the ink channel length (L) is 8 $\mu$sec.

Figure 7A:
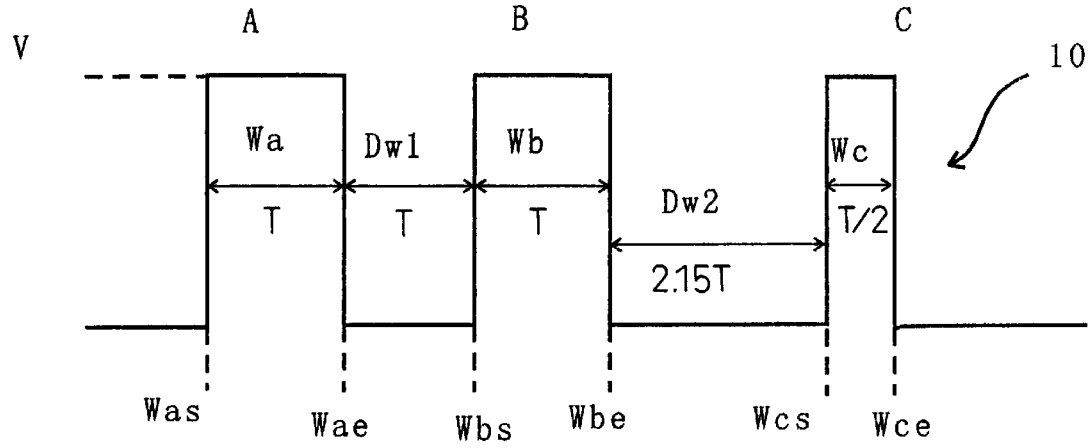
FIGS. 7A, 7B, and 7C are diagrams showing drive signals supplied to the printhead.
Figure 7B:
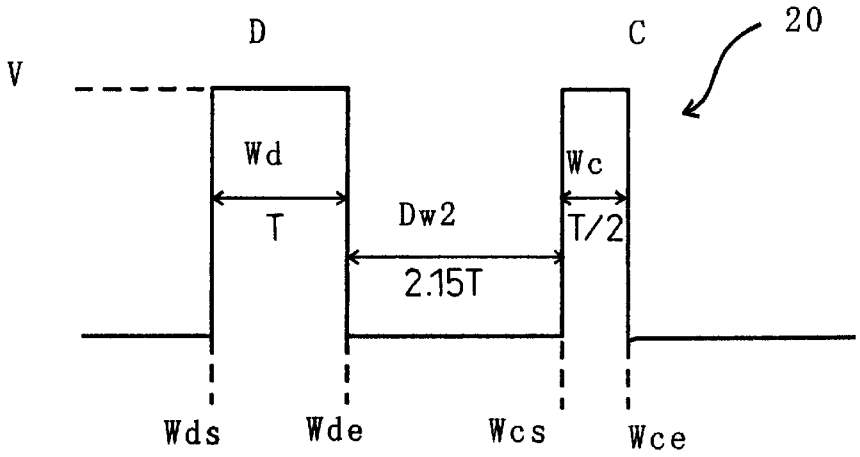
Figure 7C:
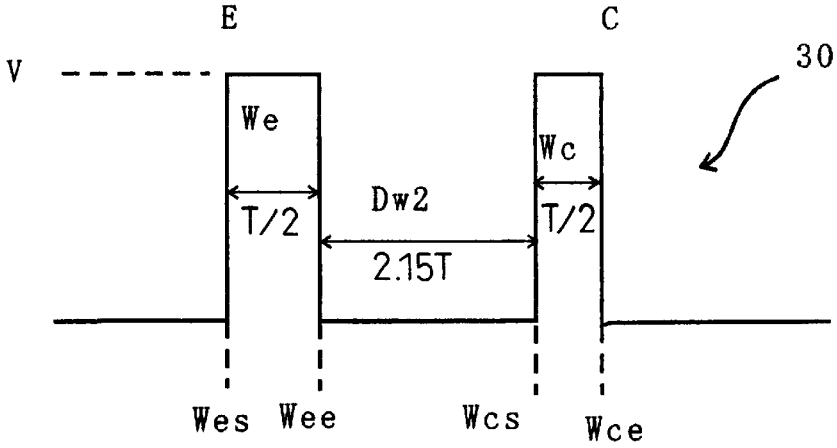

FIGS. 7A–7C show drive signals 10, 20, 30 that are applied to the electrodes 621 in the dummy channels 615. Drive signal 10, shown in FIG. 7A, includes ejection pulses A, B for ejecting ink droplets and a non-ejection pulse C for substantially canceling residual pressure wave vibrations generated by the ejection pulses A, B, in the ink channel 613. Crest values (voltage values) of the ejection pulses A, B and the non-ejection pulse C are all E [V]. In this embodiment, E is 20 V. Pulse widths Wa, Wb of the ejection pulses A, B agree with the one-way propagation time T of a pressure wave in the ink channel 613. The time T corresponds to the above-described ratio L/c, that is, 8 $\mu$sec. A pulse width Wc of the non-ejection pulse C is 0.5 times the one-way propagation time T of a pressure wave in the ink channel 613, that is, 4 $\mu$sec. A period of time Dw2 between a fall time Wbe of the ejection pulse B and a rise time Wcs of the non-ejection pulse C is 2.15 times the one-way propagation time T of a pressure wave in the ink channel 613, that is, 17.2 $\mu$sec. Ink droplets ejected by the ejection pulses A, B coalesce on the paper P or in trajectory before reaching the paper, and form a dot.

Drive signal 20 shown in FIG. 7B includes an ejection pulse D for ejecting ink droplets and a non-ejection pulse C for canceling residual pressure wave vibrations generated by the pulse D, in the ink channel 613. Crest values (voltage values) of the ejection pulse D and the non-ejection pulse C are both set to E [V], for example, 20 V. A pulse width Wd of the ejection pulse D agrees with the one-way propagation time T of a pressure wave in the ink channel 613, that is, 8 μsec. A pulse width Wc of the non-ejection pulse C is 0.5 times the one-way propagation time T of a pressure wave in the ink channel 613, that is, 4 μsec. A period of time Dw2 between a fall time Wde of the ejection pulse D and a rise time Wcs of the ejection pulse C is 2.15 times the one-way propagation time T of a pressure wave in the ink channel 613, that is, 17.2 μsec. Ink droplets ejected by the ejection pulse D are deposited on the paper P to form a dot.

Drive signal 30 shown in FIG. 7C includes an ejection pulse E for ejecting ink droplets and a non-ejection pulse C for canceling residual pressure wave vibrations generated by the ejection pulse E, in the ink channel 613. Crest values (voltage values) of the ejection pulse signal E and the non-ejection pulse signal C are both set to E [V], for example, 20 V. A pulse width We of the ejection pulse signal E is 0.5 times the one-way propagation time T of a pressure wave in the ink channel 613, that is, 4 μsec. A pulse width Wc of the non-ejection pulse C agrees with 0.5 times the one-way propagation time T of a pressure wave in the ink channel 613, that is, 4 μsec. A period of time Dw2 between a fall time Wee of the ejection pulse E and a rise time Wcs of the ejection pulse C is 2.15 times the one-way propagation time T of a pressure wave in the ink channel 613, that is, 17.2 μsec.

FIG. 9 shows the results of an ink ejection test that was conducted to optimize the pulse application timing and the pulse width of the non-ejection pulse C of drive signals 10, 20, 30.

Similar experimental results were obtained in each one of the cases where a respective one of drive signals 10, 20, 30 is applied. That is, the test results shown in FIG. 9 are common to all the cases using drive signals 10, 20, 30.

In this experiment, the ink ejection stability when ink is ejected at drive frequencies ranging from 10 to 20 kHz was evaluated by changing the time period Dw2 from 1.9T to 2.45T, and changing the pulse width Wc of the non-ejection pulse signal C from 0.1T to 0.75T. The time period Dw2 is a time period defined between each of the fall times Wbe, Wde, Wee of the respective ejection pulses 10, 20, 30 generated immediately before the non-ejection pulse C and the rise time Wcs of the non-ejection pulse C.

Generally, as the ink temperature increased and the ink viscosity decreased, ink droplets tended to curve, splash, or fail to be discharged. When the ink temperature was extremely low, for example, 5° C. or lower, the ink viscosity became too high and ink ejection was disabled. When the ink temperature was between 5° C. and 15° C., stable ink ejection was achieved even when no non-ejection pulse C was applied. On the other hand, when a non-ejection signal C was applied when the ink temperature was between 5° C. and 15° C., ink droplets were excessively ejected.

When the ink temperature was between 15° C. and 40° C., stable ink ejection was achieved if a non-ejection pulse signal C was applied such that the time period Dw2 falls within the range of 2T to 2.3T and the pulse width Wc falls within the range of 0.2T to 0.65T.

Particularly, if a non-ejection pulse signal C was applied such that the time period Dw2 falls within the range of 2.1T to 2.2T and the pulse width Wc falls within the range of 0.3T to 0.55T, stable ink ejection was achieved until the ink temperature reached 50° C.

The experimental results show that, when the ink temperatures exceeds 15° C., stable ink ejection can be achieved by applying a non-ejection pulse C upon expiration of 2.0T to 2.3T, or more preferably 2.1T to 2.2T after each of the ink ejection pulses B, D, E falls. The pulse width of a non-ejection pulse to be applied should be 0.2T to 0.65T, or more preferably 0.3T to 0.55T.

Figure 4:
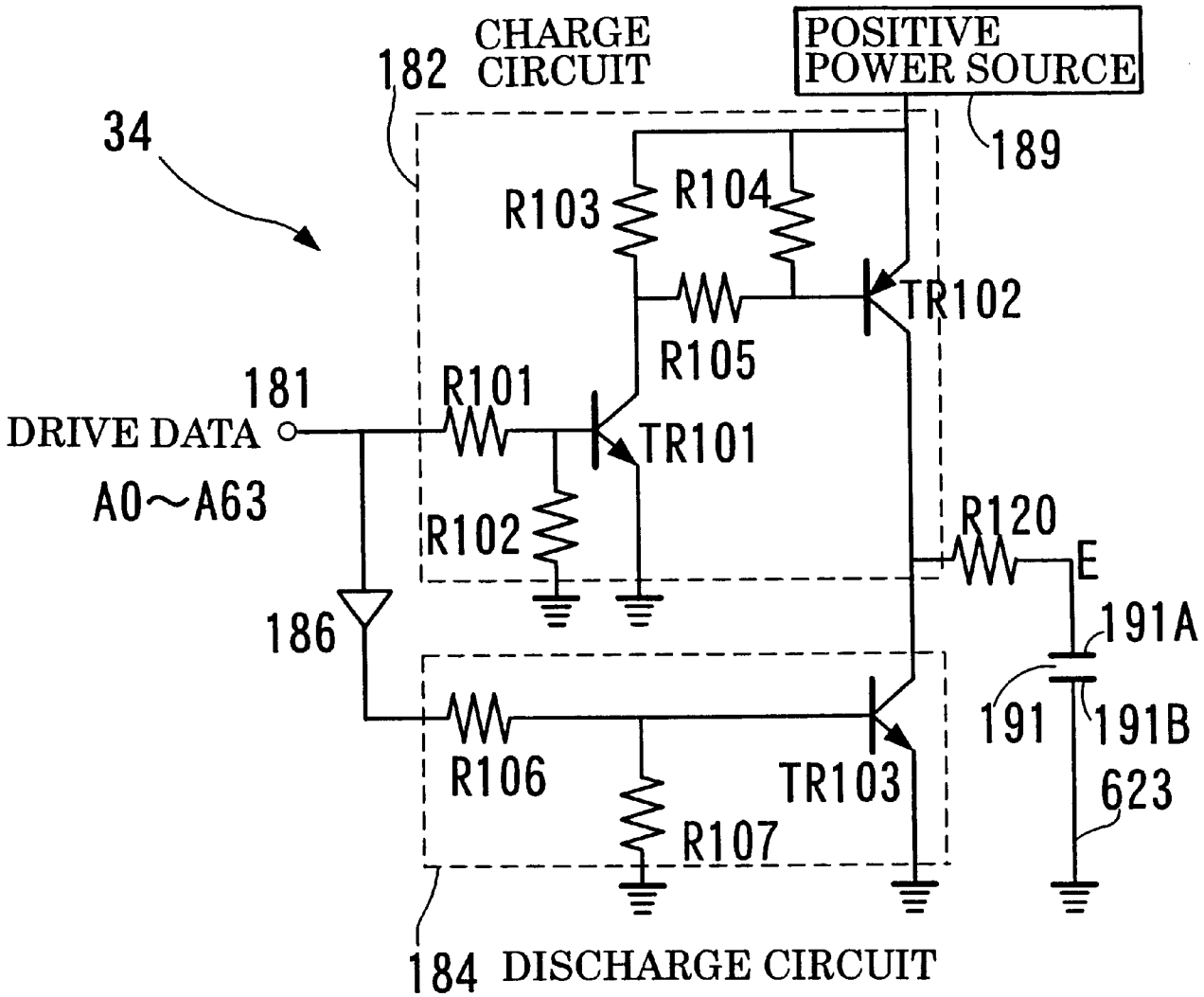
FIG. 4 is a diagram showing the detailed configuration of an output circuit of FIG. 3.

Referring now to FIGS. 4 and 5, one example of the output circuit 34 that can generate drive signals having such parameters will be described by taking drive signal 10 as an example.

The output circuit 34 shown in FIG. 4 includes a charge circuit 182, a discharge circuit 184, and a phase inverter 186.

The charge circuit 182 includes resistances R101–R105 and transistors TR101, TR102.

Figure 13:
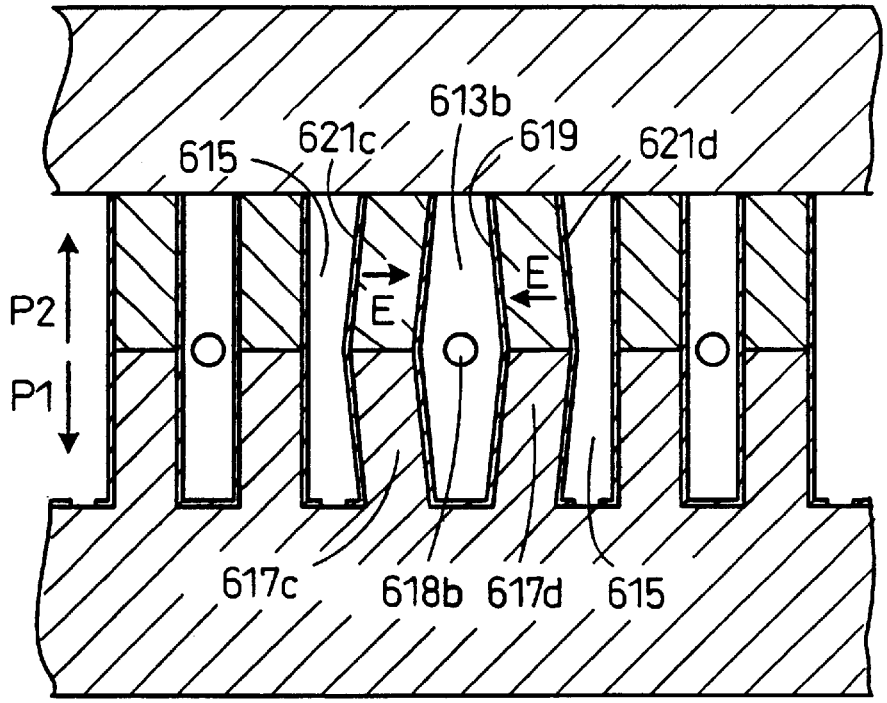
FIG. 13 is a diagram showing the operation of the printhead of FIG. 12.

When the drive data A0–A63 (+5 V) is inputted to an input terminal 181, the transistor TR101 is rendered conducting via the resistance R101, and a current flows from a positive power source 189, via the resistance R103, to a collector and then to an emitter of the transistor TR101. Thus, partial pressure applied to the resistances R104, R105, which are connected to the positive power source 189, increases, and a larger current flows into a base of the transistor TR102. Then, a corrector and an emitter of the transistor TR102 is rendered conducting. A voltage of 20 V from the positive power source 189 is applied to associated electrodes 621 in the dummy channels 615, via the corrector and the emitter of the transistor TR102, and the resistance R120. In an exemplary case shown in FIG. 13, a voltage of 20 V is applied to the electrodes 621*c*, 621*d* in order to eject ink from the nozzle 618*b* of the ink channel 613*b*.

When the drive data A0–A63 of +5 V is inputted as described above, electric fields are generated in the directions of arrows E on both sidewalls 617*c*, 617*d* of the ink channel 613*b*. Then, the upper and lower portions of the sidewalls 617*c*, 617*d* deform, by a piezoelectric shearing effect, in such directions that the volumetric capacity of the ink channel 613*b* increases. Capacitors 191A, 191B represent the deforming sidewalls 617*c*, 617*d*, respectively, and are charged upon the application of a voltage to the electrodes 621*c*, 621*d*.

In this way, the drive data A0–A63 of +5 V is inputted in a timed sequence with T1, T3, and T5 of the timing chart shown in FIG. 5(*a*). That is, the drive data A0–A63 is inputted at the rising edge of an ejection pulse or a non-ejection pulse.

The discharge circuit 184 will now be described. The discharge circuit 184 includes resistances R106, R107 and a transistor TR103. The drive data A0–A63 is inputted to the discharge circuit 184 via a phase inverter 186. When the drive data A0–A63 becomes 0V, the drive data A0–A63 is inverted into opposite phase by the phase inverter 186, and a voltage of +5 V is applied to the resistance R106. Then, the transistor TR103 is rendered conducting, and charges accumulated on the sidewalls 617*c*, 617*d* are discharged via the resistance R120. When the charges are discharged, the potential of each of the electrodes 617*c*, 617*d* is bought into a grounded state. At this time, the sidewalls 617*c*, 617*d* that have deformed return to their original shapes. The drive data A0–A63 becomes 0V in a timed sequence with T2, T4, and T6 of the timing charts shown in FIGS. 5A–5C. That is, the drive data A0–A63 becomes 0V at the falling edge of an ejection pulse or a non-ejection pulse.

Figures 5A, 5B, 5C:
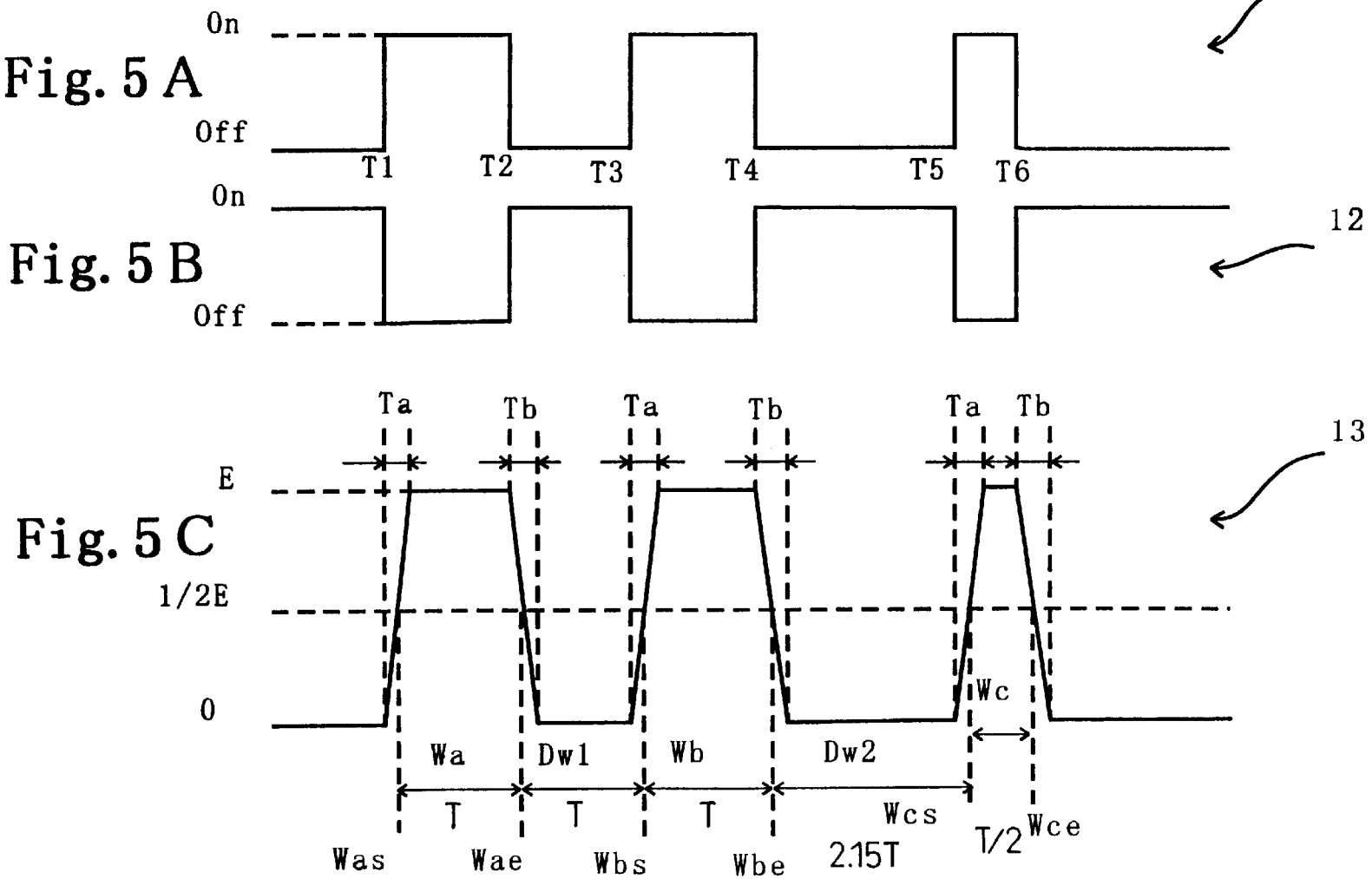
FIGS. 5A, 5B, and 5C are charts showing the driving timing of a printhead.

An input signal 11, shown in FIG. 5A, is inputted to the charge circuit 182 and has the same waveform as that of drive signal 10. The input signal 11 is normally off, and turned on and off at a predetermined timing, that is, turned on at time T1 and off at T2, and then, tuned on at T3, off at T4, on at T5, and off at T6.

An input signal 12, shown in FIG. 5B, is inputted to the discharge circuit 184 and is opposite, in phase, to drive signal 10. The input signal 12 is turned off at T1, T3, and TS when the input signal 11 is turned on, and is turned on at T2, T4, and T6 when the input signal 11 is turned off.

An output signal 13, shown in FIG. 5C, represents the potential at point E of the output circuits 34 of FIG. 4. The potential at point E represents the potential of the electrode 621. The output signal 13 is normally kept at 0 V. When a drive data of +5V is applied to the electrode 621 at T1 and the sidewall 617 is charged, the potential of the output signal 13 rises to a voltage of E [V], for example, 20 V after an elapse of a charge time Ta. The charge time Ta is determined by the transistor TR103, the resistance R120, and the electrostatic capacitance of the sidewall 617.

When the drive data is changed from +5 V to 0 V at T2, the potential of the electrode 621 falls to 0 V after the expiration of a discharging time Tb, which is determined by the transistor TR103, the resistance R120, and the electrostatic capacitance of the sidewall 617.

As is apparent from FIGS. 5A–5C, the rise and fall of the potential actually applied to the electrode 621 are delayed by Ta and Tb from the rise and fall of drive signal 10 since there are delays of Ta and Tb, respectively. Therefore, times T3, T4, T5, and T6 of drive signal 10 should be set such that a period of time Dw2 between time Wbc at which the potential of the ejection pulse B falls to E/2 [V] (in this embodiment, 10 V) and time Wcs at which the potential of the ejection pulse B rises to E/2 [V] (10 V) agrees with a value shown in FIG. 7A, that is, 17.2 $\mu$m in this embodiment.

Similar time setting should be performed also for drive signals 20, 30 such that the above-mentioned time period Dw2 agrees with values shown in FIGS. 7B and 7C, respectively.

It is noted that the charge circuits 182 and the discharge circuits 184 are provided in one-to-one correspondence with the nozzles of the printhead 600.

Figure 6:
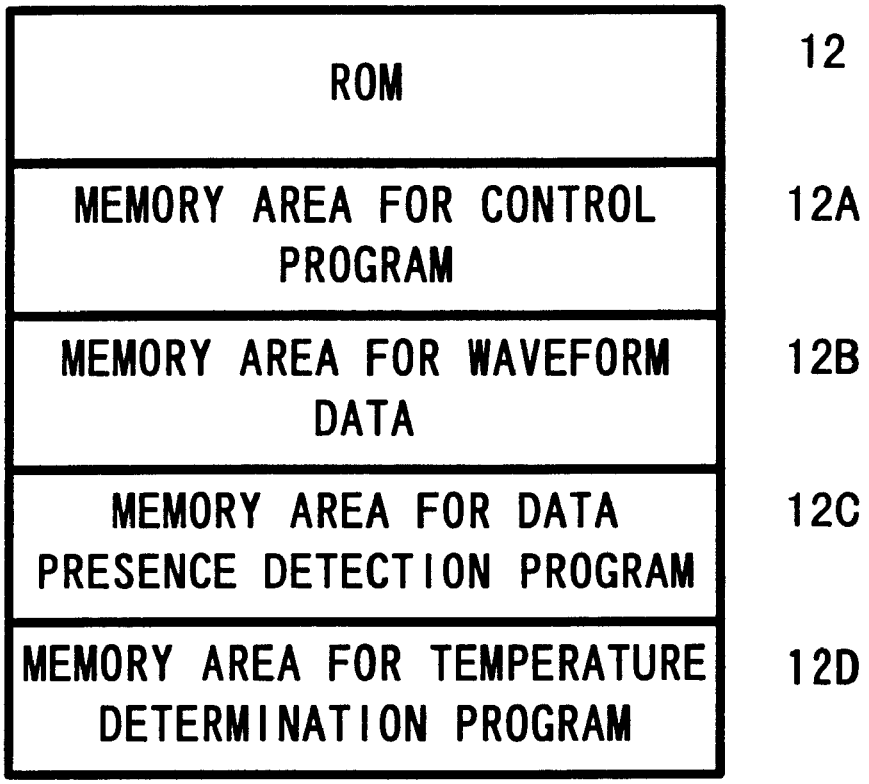
FIG. 6 is a diagram showing memory areas of a ROM of a control circuit.

As shown in FIG. 6, the ROM 12 is provided with a memory area 12A for storing an ink ejection control program, a memory area 12B for storing drive waveform data, that is, data on the print clock ICK generation timing T1–T6 for controlling on/off of drive signals 10, 20, 30, a memory area 12C for storing a data presence detection program, which will be described in detail later, and a memory area 12D for storing a temperature determination program.

The microcomputer 11 selectively reads the timing data stored in the memory area 12B of the ROM 12, and outputs drive pulses, such as drive signals 10, 20, 30 shown in FIG. 7. In addition, the microcomputer 11 sets a control value m in a predetermined area in the RAM 13 according to the data presence detection program stored in the memory area 12C. After the microcomputer 11 supplies, in cooperation with the RAM, the transmission data DATA to each output circuit 34 associated with each nozzle 618, the microcomputer 11 decrements the control value m at intervals of a predetermined time or a predetermined time measured by the transmission clock TCK, and selects the drive waveform based on the control value m. Further, the microcomputer 11 selects the print control and the drive waveform suitable for the temperature detected by the temperature sensor 18 according to the temperature determination program stored in the memory area 12D.

FIG. 8A is a table showing the ink droplet ejection velocity and the ink droplet volume obtained when the printhead 600 actually ejects ink droplets using drive signals 10, 20, 30. When the temperature of the printhead 600 is 25° C. (the temperature of ink is assumed to be approximately 25° C.), the velocity and the volume of ink droplets ejected upon the application of a voltage of 20 V during normal continuous printing are 8.0 m/s and 38.0 pl (picoliters) with drive signal 10, 8.0 m/s and 20.0 pl with drive signal 20, and 6.5 m/s and 10.0 pl with drive signal 30. In contrast, when ink ejection is performed for the first time after the nozzle 618 has been exposed to air in a non-ejection state, for example, for approximately two seconds, the ink droplet ejection velocity and the ink droplet volume are 7.2 m/s and 23.0 pl with drive signal 10, 5.3 m/s and 11 pl with drive signal 20, and 3.5 m/s and 5.0 pl with drive signal 30. In any case, the ink ejection velocity and the ink droplet volume are less than those obtained during normal continuous printing.

The printhead 600 ejects ink droplets to paper P to form a printed pattern on the paper P, while traveling spaced away therefrom a predetermined distance. When the ink droplet ejection velocity decreases, the ink droplet striking position on the paper is displaced. When the ink droplet volume decreases, an ink droplet tends to be affected by a crosswind generated when the printhead 600 travels, and the ink droplet striking position is further displaced.

To prevent displacements of the ink droplet string positions, the ejection velocity and the droplet volume of ink ejection performed during normal continuous printing should be equal to those of an initial ink ejection performed after the nozzle has been exposed to air in a non-ejection state for a while.

Therefore, this embodiment proposes combinations of drive signals suitable for ink ejection during normal continuous printing and an initial ink ejection after the nozzle 618 has been exposed to air for a while, for either of the printing modes, printing at medium resolution between 600 and 720 dpi or printing at high resolution between 1200 and 1400 dpi.

FIG. 8B shows an exemplary combination of drive signals suitable for printing at medium resolution. When drive signal 20 is used for normal continuous printing, the ejected ink droplet volume is 20 pl and suitable for printing at medium resolution between 600 and 720 dpi. At this time, the ejection velocity is 8.0 m/s. On the other hand, when drive signal 10 is used for an initial ejection after the nozzle 618 has been exposed to air in a non-ejection state for a while, the ejected ink droplet volume is 23 pl and the ejection velocity is 7.2 m/s. Thus, ink ejection is performed at substantially the same level as achieved during normal continuous printing.

FIG. 8C shows an exemplary combination of drive signals suitable for printing at high resolution. When drive signal 30 is used for normal continuous printing, the ejected ink droplet volume is as small as 10 pl and suitable for printing at high resolution between 1200 and 1440 dpi. At this time, the ejection velocity is 6.5 m/s. On the other hand, when drive signal 20 is used for an initial ejection after the nozzle 618 has been exposed to air in a non-ejection state for a while, the ejected ink droplet volume is 11 pl and the ejection velocity is 5.3 m/s. Thus, ink ejection is performed at substantially the same level as achieved during normal continuous printing.

In either resolution, displacements of the ink striking positions are unlikely to occur even at an initial ejection performed after the nozzle 618 has been exposed to air in a non-ejection state for a predetermined time.

Figure 10:
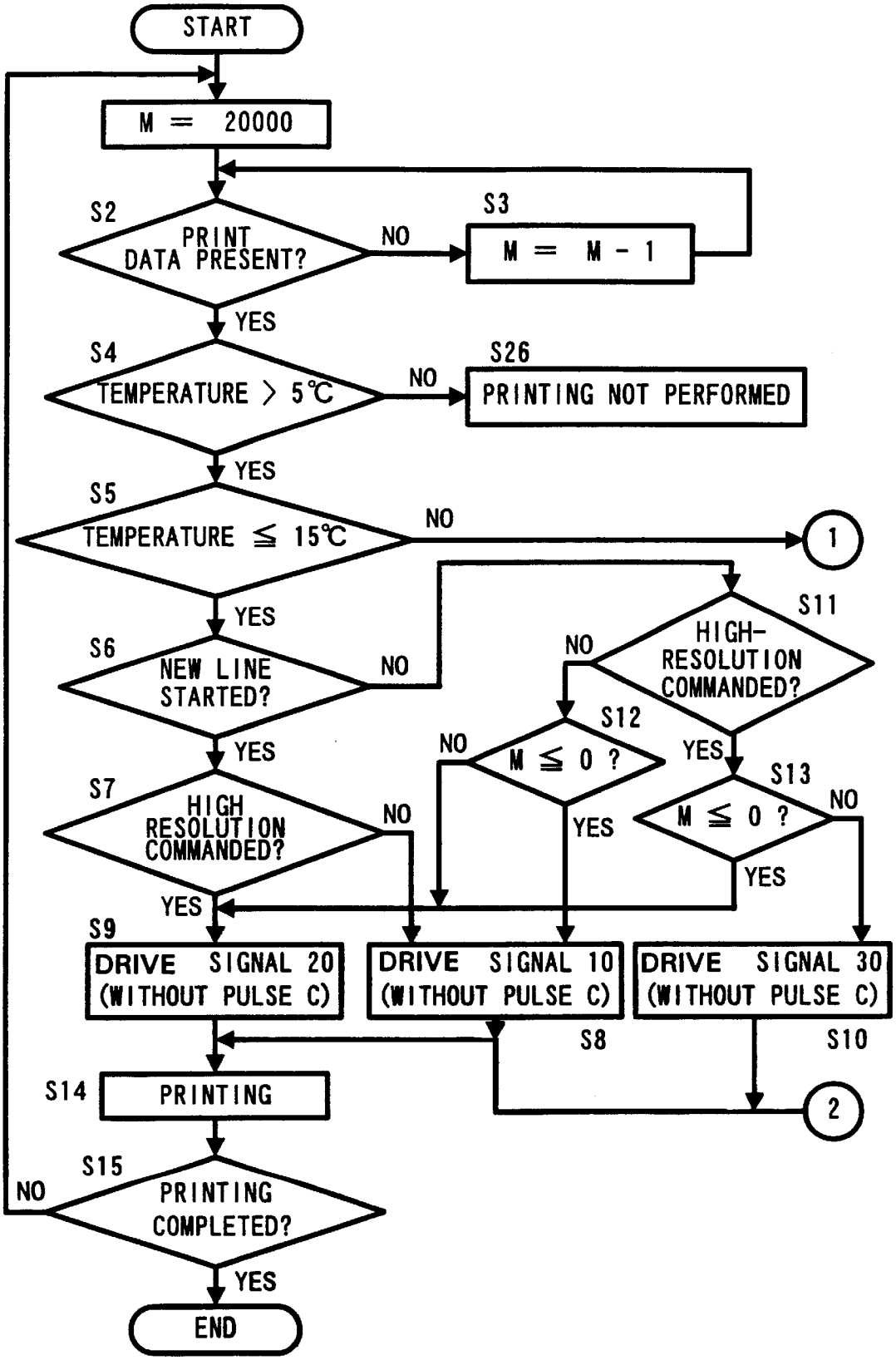
FIG. 10 is a flowchart showing a control routine of the printer.
Figure 11:
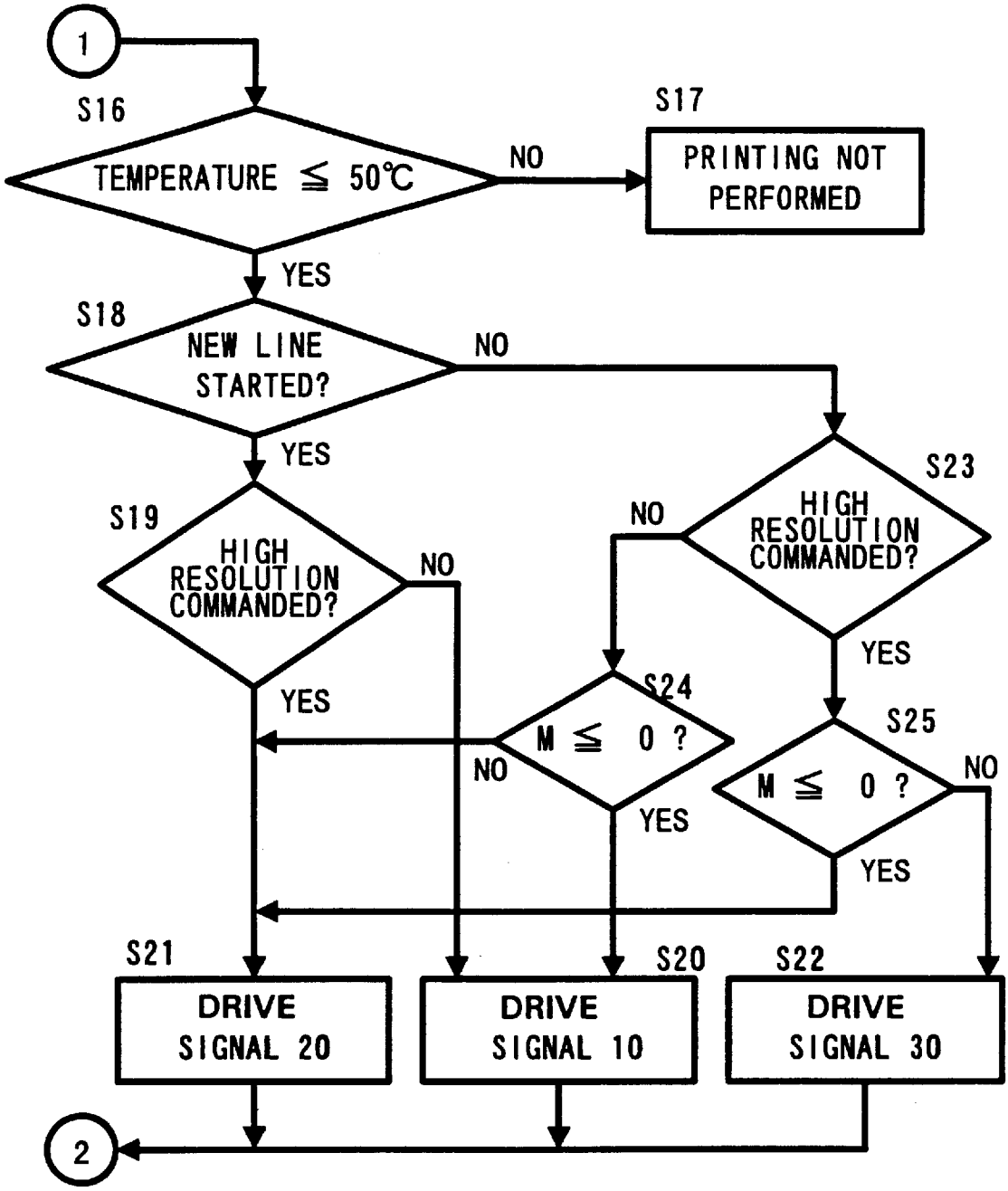
FIG. 11 is a flowchart continuing the a control routine of the printer.

Referring now to the flowcharts shown in FIGS. 10 and 11, a control routine for selecting the drive signal according to the ambient temperature and the printing resolution will be described.

When operation of the printer including the printhead 600 is started, the control value m corresponding to a predetermined number of non-ejection dots is set (S1). In this embodiment, print quality critically deteriorates when the nozzles 618 are exposed to air in a non-ejection state over 2 seconds. Thus, if a non-ejection state lasts over 2 seconds, the drive signal must be changed. The control value m is set as a reference value to determine how much time has elapsed since the onset of a non-ejection state. When the transmission clock TCK is driven at 10 kHz, 20,000 (10,000×2) non-ejection dots correspond to an elapse of 2 seconds. Accordingly, 20,000 is set as the control value m.

When the cap 514 is removed from the printhead 600, the presence or absence of print data is detected for each of the nozzles 618 of the printhead 600. When the nozzle 618 lacks print data and is exposed to air in a non-ejection state (S2: No), the control value m is decremented by one at each cycle of the transmission clock TCK (S3). When print data is present for the nozzle 618 (S2: Yes), the ambient temperature is detected by the temperature sensor 18 (S4). When the detected temperature is 5° C. or lower (S4: No), printing is not performed because the temperature is too low (S26), and operation of the printer is terminated. When the detected temperature is over 5° C., (S4: YES), it is determined whether the temperature is 15° C. or lower (S5). When the temperature is 15° C. or lower (S5: Yes), it is determined whether a new line is started by the linefeed mechanism LF (S6). When a new line is started (S6: Yes), it is determined whether printing at high resolution (1200–1440 dpi) is commanded (S7). When it is determined that high-resolution printing is commanded (S7: Yes), drive signal 20 is selected (S9). In this case, drive signal 20 is not followed by a non-ejection pulse C because the ambient temperature is 15° C. or lower. When it is determined that printing at medium resolution (600–720 dpi) is commanded (S7: No), drive signal 10 is selected. In this case, drive signal 10 is not followed by a non-ejection pulse C because the ambient temperature is 15° C. or lower.

Then, printing is executed (S14), while ink is ejected in timed relation to the rising/falling edges of ejection pulses defined by the selected drive signal. When print data to be printed still remains (S15: No), the control value m is set again to 20,000 (S1). When no print data to be printed remains (S1: Yes), printing is terminated.

When high-resolution printing is commanded and the temperature is 15° C. or lower, and because a new line is started, the nozzles 618 are exposed to air in a non-ejection state until the printhead 600 moves to the printing start position in the next line. For this reason, in this case, drive signal 20 (without a non-ejection pulse C) is selected, in S9, regardless of the control value m.

In other words, an ejection pulse having a pulse width of T defined by drive signal 20 is issued, instead of an ejection pulse having a pulse width of T/2 defined by drive signal 30. This will compensate for a decrease in ink ejection velocity and a decrease in ink droplet volume, which are caused by an increase in ink viscosity with decreasing temperature. Likewise, when medium-resolution printing is commanded, drive signal 20 (without a non-ejection pulse) is selected during normal continuous printing. However, after a new line is started, drive signal 10 (without a non-ejection pulse C) is selected for the same reason as described above. In this case, two ejection pulses having a pulse width of T that are defined by drive signal 10 are issued instead of an ejection pulse having a pulse width of T that is defined by drive signal 20.

When a new line is not started in step S6 (S6: No) and when high-resolution printing is commanded (S11: Yes), it is determined whether the control value m is 0 or less (S13). When the control value m is greater than 0, that is, less than 2 seconds have elapsed since the previous ink ejection (S13: No), drive signal 30 (which is not followed by a non-ejection pulse C because the temperature is 15° C. or lower) for normal continuous printing is selected (S10). Then, printing is executed as described above (S14).

When the control value m is 0 or less (S13: Yes), it indicates that a non-ejection state has lasted for more than 2 seconds. Thus, drive signal 20 (which is not followed by a non-ejection pulse because the temperature is 15° C. or lower) is selected (S9), and printing is executed as described above (S14). In this case, an ejection pulse having a pulse width of T defined by drive signal 20 is issued, instead of an ejection pulse having a pulse width of T/2 defined by drive signal 30.

When a new line is not started in step S6, (S6: No) and when medium-resolution printing is commanded (S11: No), it is determined whether the control value m is 0 or less (S12). When the value m is greater than 0 (S12: No), drive signal 20 (which is not followed by a non-ejection pulse C because the temperature is 15° C. or lower) for normal continuous printing is selected (S20). Then, printing is executed based on drive signal 20, as described above (S14).

When the control value m is 0 or less (S12: Yes), it indicates that a non-ejection state has lasted for more than 2 seconds. Thus, drive signal 10 (which is not followed by a non-ejection pulse because the temperature is 15° C. or lower) is selected (S8), and printing is executed as described above (S14). In this case, two ejection pulses having a pulse width of T defined by drive signal 10 are issued instead of one ejection pulse having a pulse width of T defined by drive signal 20.

Under this control, when ink is ejected from any one of the nozzles that has been kept in a non-ejection state for over 2 seconds, a drive signal is applied so as to compensate for an ejection defect caused by an increase in the ink viscosity. Thus, high print quality can be maintained.

When the temperature is over 15° C., in step S5 (S5: No), it is further determined whether the temperature is 50° C. or lower (S16). When the detected temperature is over 50° C. (S16: No), the ink viscosity is too low to achieve satisfactory print quality. Thus, printing is not performed (S17), and operation of the printer is terminated.

When the temperature is 50° C. or lower (S16: Yes), it is determined whether a new line is started (S18). When a new line is started (S18: Yes), it is determined whether a high-resolution printing is commanded (S19). When it is determined that a high-resolution printing is commanded (S19: Yes), drive signal 20 is selected (S21).

When it is determined that high-resolution printing is not commanded (S19: No), it indicates that medium-resolution printing is commanded. Thus, drive signal 10 is selected (S20), and printing is executed as described above (S14).

In short, when high-resolution printing is commanded and the temperature is over 15° C. and below or equal to 50° C., drive signal 20 is selected when a new line is started because the nozzle 618 is exposed to air in a non-ejection state and the nozzle and its vicinity tends to be dried. Thus, drive signal 20 is selected regardless of the control value m.

Thereby, under this control, an ejection pulse having a pulse width of T defined by drive signal 20 is issued, instead of an ejection pulse having a pulse width of T/2 defined by drive signal 30.

Execution of printing according to drive signal 20 compensates for a decrease in ink ejection velocity and a decrease in ink droplet volume, and prevents deterioration in print quality. Likewise, when medium-resolution printing is commanded, drive signal 20 is selected during normal continuous printing. However, when a new line is started, drive signal 10 is selected for the same reason as described above, and printing is executed based on drive signal 10.

In short, in order to print a dot, two ejection pulses having a pulse width of T defined by drive signal 10 are issued instead of one ejection pulse having a pulse width of T defined by drive signal 20.

When it is determined that a new line is not started in step S18 (S18: No) and that high-resolution printing is commanded (S23: Yes), it is determined whether the control value m is 0 or less (S25). When the control value m is greater than 0, that is, when less than 2 seconds has elapsed since the previous ink ejection (S25: No), drive signal 30 for normal continuous printing is selected (S22). Then, printing is executed based on drive signal 30, as described above (S14).

When the control value m is 0 or less (S25: Yes), it indicates that the nozzle has been in a non-ejection state for more than 2 seconds. Thus, drive signal 20 is selected (S20), and printing is executed according to drive signal 20 (S14). In this case, a pulse width of T is used instead of the pulse width of T/2 used for normal continuous printing.

When it is determined that a new line is not started in step S18, (S18: No) and that medium-resolution printing is commanded (S23: No), it is determined whether the control value m is 0 or less (S24). When the control value m is greater than 0 (S24: No), that is, when less than 2 seconds has elapsed since the previous ink ejection, drive signal 20 for normal continuous printing is selected (S21). Then, printing is executed based on drive signal 20, as described above (S14).

When the control value m is 0 or less (S24: Yes), it indicates that the nozzle has been in a non-ejection state for more than 2 seconds. Thus, drive signal 10 is selected (S20), and printing is executed according to drive signal 10. In this case, two ejection pulses having a pulse width of T are issued instead of one ejection pulse having a pulse width of T.

As described above, for an initial ejection from the nozzle that has been in a non-ejection state for more than 2 seconds, drive signal 20 is selected, in the high-resolution printing mode, to make the pulse width of an initial ejection pulse longer than normal to prevent an ink ejection defect caused by an increase in ink viscosity. In the medium-resolution printing mode, drive signal 10 is selected to make the number of pulses greater than normal.

By executing the above-described control routine, displacements of the ink striking positions can be minimized when ink droplets as tiny as 20 pl are ejected, regardless of the printing resolution and the temperature change.

While the invention has been described in respect of the preferred embodiment, it will be understood that it is not intended to limit the invention to this embodiment, and that various changes may be made therein to embody the invention without departing from the spirit of the invention. Although, in the embodiment, the drive signal is controlled to be changed when a non-ejection state lasts two seconds or longer, the reference non-ejection time may be changed to an appropriate value depending on the printhead type and the ink type. Various changes and modifications may be made in the embodiment based on the knowledge of a person of ordinary skill in the art.

Although, in the embodiment, the drive signal, different from the one used for normal continuous printing, is used only for an initial ink ejection from the nozzle that has been exposed to air in a non-ejection state, the drive signal different from the normal one may be used for a plurality of ink ejections.

Further, although pulse widths Wa, Wb, and Wd of ejection pulses A, B, and C are set, respectively, to agree with the one-way propagation time T, pulse widths Wa, Wb, and Wd may be odd multiples of T.

What is claimed is:

1. An ink jet apparatus, comprising:

a nozzle from which ink is ejected, an ink chamber filled with ink and connected to the nozzle;

an actuator that applies energy to the ink within the ink chamber; and a control device that generates an ejection pulse in response to a print command and applies the ejection pulse to the actuator, wherein when the control device determines that the nozzle has been continuously kept in a non-ejection state, the control device sets a longer application time of an ejection pulse, in response to an initial print command issued after the determination, than the application time of an ejection pulse the control device sets in response to a print command issued during normal continuous printing.

2. The ink jet apparatus according to claim 1, wherein when the control device determines that the nozzle has been continuously kept in the non-ejection state, the control device sets a longer pulse width of an ejection pulse, in response to the initial print command issued after the determination, than the pulse width of an ejection pulse the control device sets in response to the print command issued during normal continuous printing.

3. The ink jet apparatus according to claim 1, when the control device determines that the nozzle has been continuously kept in the non-ejection state, the control device sets a greater number of ejection pulses, in response to the initial print command issued after the determination, than the number of ejection pulses the control device sets in response to the print command issued during normal continuous printing.

4. The ink jet apparatus according to claim 1, wherein when the control device determines that a new line has been started prior to issuance of a print command, the control device sets a longer application time of an ejection pulse, in response to an initial print command issued after the determination, than the application time of an ejection pulse the control device sets in response to a print command issued during normal continuous printing.

5. The ink jet apparatus according to claim 4, wherein when the control device determines that the new line has been started prior to issuance of the print command, the control device sets a longer pulse width of an ejection pulse, in response to the initial print command issued after the determination, than the pulse width of an ejection pulse the control device sets in response to the print command issued during normal continuous printing.

6. The ink jet apparatus according to claim 4, wherein when the control device determines that the new line has been started prior to issuance of the print command, the control device sets a greater number of ejection pulses, in response to the initial print command issued after the determination, than the number of ejection pulses the control device sets in response to the print command issued during normal continuous printing.

7. The ink jet apparatus according to claim 1, wherein the actuator increases and decreases a volumetric capacity of the ink chamber, according the ejection pulse applied thereto, and generates, in the ink chamber, a pressure wave, by which the ink is ejected from the nozzle.

8. The ink jet apparatus according to claim 7, wherein the control device determines a pulse width of the ejection pulse and a number of ejection pulses to change a volume of an ink droplet ejected from the nozzle in accordance with various resolutions.

9. The ink jet apparatus according to claim 7, wherein the control device applies to the actuator a non-ejection pulse following the ejection pulse so as to cancel vibrations of the wave pressure generated by the ejection pulse.

10. The ink jet apparatus according to claim 9, wherein the non-ejection pulse is generated upon expiration of a time period between 2.0T and 2.3T, or more preferably, between 2.1T and 2.2T after the ejection pulse falls, and a pulse width of the non-ejection pulse is between 0.2 T and 0.65T, or more preferably, between 0.3T and 0.55T, T representing a time required for the pressure wave to propagate along the ink chamber and being given by an expression T=L/c (L being a length of the ink channel, and c being a speed of sound in the ink).

11. An ink ejection apparatus, comprising:

a printhead having a plurality of ink ejection channels;

an actuator associated with each ink ejection channel of the plurality of ink ejection channels; and a controller for controlling each actuator based on print instructions and ink ejection apparatus conditions; and a determination means for determining whether an ink channel has been in a non-ejection state for a predetermined condition and when the determination is positive increases ejection parameters and when the determination is negative, uses predetermined ejection parameters for continuous printing.

12. The ink ejection apparatus according to claim 11, wherein the determination means includes a temperature detector and a new line detector, when the temperature detector determines the temperature is below a first predetermined temperature but above a second predetermined temperature, the controller establishes a first set of ejection parameters and when the temperature is above the first predetermined temperature but below a third predetermined temperature, the controller establishes a second set of ejection parameters.

13. The ink ejection apparatus according to claim 12, wherein the controller determines a pulse signal selected from one of the first set of ejection parameters and the second set of parameters based on detection of a new line by the new line detector.

14. The ink ejection apparatus according to claim 13, further comprising a print resolution determiner that determines whether high resolution printing is required.

15. The ink ejection apparatus according to claim 14, further comprising a timer, wherein non-continuous printing for an ink channel is determined when the timer count exceeds a predetermined count.

16. The ink ejection apparatus according to claim 12, wherein the ejection parameters are a number of ejection pulses and a width of ejection pulses.

17. The ink ejection apparatus according to claim 16, wherein a non-ejection pulse is included in the ejection parameters of the second set of ejection parameters.

18. A method of controlling ink ejection from an ink channel of a printer, comprising:

establishing a plurality of print pulse parameters;

setting a timer to count a predetermined time used to identify non-continuous printing;

determining a temperature;

determining whether printing of a new line is commenced;

determining whether high resolution printing is selected; and establishing ejection parameters on a basis of the time, temperature, new line printing status and printing resolution.

19. The method according to claim 18, wherein the established ejection parameters provide for a stronger ejection pulse following non-continuous printing than during continuous printing.

20. The method according to claim 19, wherein the stronger ejection pulse is provided by increasing at least one of a number of ejection pulses and a width of ejection pulses.

21. An ink jet apparatus, comprising:

a nozzle from which ink is ejected;

an ink chamber filled with ink and connected to the nozzle; and a control device that generates an ejection pulse in response to a print command and applies the ejection pulse to the actuator, wherein when the control device determines that the nozzle has been continuously kept in a non-ejection state, the control device sets a greater number of ejection pulses, in response to an initial print command issued after the determination, than the number of ejection pulses the control device sets in response to a print command issued during normal continuous printing.

22. The ink jet apparatus according to claim 21, wherein when the control device determines that a new line has been started prior to issuance of a print command, the control device sets a greater number of ejection pulses, in response to an initial print command issued after the determination, than the number of ejection pulses the control device sets in response to a print command issued during normal continuous printing.

23. The ink jet apparatus according to claim 21, wherein the actuator increases and decreases a volumetric capacity of the ink chamber, according to the ejection pulse applied thereto, and generated, in the ink chamber, a pressure wave, by which the ink is ejected from the nozzle.

24. The ink jet apparatus according to claim 23, wherein the control device determines a pulse width of the ejection pulse and a number of ejection pulses to change a volume of an ink droplet ejected from the nozzle in accordance with various resolutions.

25. The ink jet apparatus according to claim 23, wherein the control device applies to the actuator a non-ejection pulse following the ejection pulse so as to cancel vibrations of the wave pressure generated by the ejection pulse.

26. The ink jet apparatus according to claim 25, wherein the non-ejecting pulse is generated upon expiration of a time period between 2.0T and 2.3T, or more preferably, between 2.1T and 2.2T after the ejection pulse falls, and a pulse width of the non-ejection pulse is between 0.2T and 0.65T, more preferably, between 0.3T and 0.55T representing a time required for the pressure wave to propagate along the ink chamber and being given by an expression T=L/c, L being a length of the ink chamber and c being a speed of sound in the ink.

27. An ink jet apparatus, comprising:

a nozzle from which ink is ejected;

an ink chamber filled with ink and connected to the nozzle; and a control device that generates an ejection pulse in response to a print command and applies the ejection pulse to the actuator, wherein when the control device determines that the nozzle has been continuously kept in a non-ejection state, the control device sets a pulse width of an ejection pulse, in response to an initial print command issued after the determination, which is set to be nearer odd multiples of T than the pulse width of an ejection pulse the control device sets in response to a print command issued during normal continuous printing, T representing a time required for the pressure wave to propagate along the ink chamber and being given by an expression T=L/c, L being a length of the ink chamber and c being a speed of sound in the ink.

28. The ink jet apparatus according to claim 27, wherein when the control device determines that a new line has been started prior to issuance of a print command, the control device sets a pulse width of an ejection pulse, in response to an initial print command issued after the determination, which is set to be nearer odd multiples of T than the pulse width of an ejection pulse the control device sets in response to a print command issued during normal continuous printing.

29. The ink jet apparatus according to claim 27, wherein the actuator increases and decreases a volumetric capacity of the ink chamber, according to the ejection pulse applied thereto, and generates, in the ink chamber, a pressure wave, by which the ink is ejected frmo the nozzle.

30. The ink jet apparatus according to claim 29, wherein the control device determines a pulse width of the ejection pulse and a number of ejection pulses to change a volume of an ink droplet ejected from the nozzle in accordance with various resolutions.

31. The ink jet apparatus according to claim 29, wherein the control device applies to the actuator a non-ejection pulse following the ejection pulse so as to cancel vibrations of the wave pressure generated by the ejection pulse.

32. The ink jet apparatus according to claim 31, wherein the non-ejecting pulse is generated upon expiration of a time period between 2.0T and 2.3T, or more preferably, between 2.1T and 2.2T after the ejection pulse falls, and a pulse width of the non-ejection pulse to between 0.2T and 0.65T, or more preferably, between 0.3T and 0.55T, T representing a time required for the pressure wave to propagate along the ink chamber and being given by an expression T=L/c, L being a length of the ink chamber and c being a speed of sound in the ink.

33. The method according to claim 19, wherein the stronger ejection pulse is provided by setting a pulse width of an ejection pulse as near odd multiples of T, T representing a time required for the pressure wave to propagate along the ink chamber and being given by an expression T=L/c, L being a length of the ink chamber and c being a speed of sound in the ink.

* * * * *